US010059413B2

(12) United States Patent
Bertin

(10) Patent No.: US 10,059,413 B2
(45) Date of Patent: Aug. 28, 2018

(54) MINE SWEEPING APPARATUS

(71) Applicant: CALZONI S.r.l., Calderara di Reno (IT)

(72) Inventor: Daniele Maria Bertin, Milan (IT)

(73) Assignee: CALZONI S.R.L., Calderara di Reno (IT)

( * ) Notice: Subject to any disclaimer, the term of this patent is extended or adjusted under 35 U.S.C. 154(b) by 0 days.

(21) Appl. No.: 15/543,830

(22) PCT Filed: Jan. 26, 2016

(86) PCT No.: PCT/IB2016/050372

§ 371 (c)(1),
(2) Date: Jul. 14, 2017

(87) PCT Pub. No.: WO2016/120782

PCT Pub. Date: Aug. 4, 2016

(65) Prior Publication Data

US 2017/0361909 A1 Dec. 21, 2017

(30) Foreign Application Priority Data

Jan. 27, 2015 (IT) ..... BO2015A0027

(51) Int. Cl.

| | |
|---|---|
| ***B63G 7/02*** | (2006.01) |
| ***B63G 8/16*** | (2006.01) |
| ***B63G 8/28*** | (2006.01) |
| ***B63G 8/42*** | (2006.01) |

(52) U.S. Cl.
CPC ..... *B63G 7/02* (2013.01); *B63G 8/16* (2013.01); *B63G 8/28* (2013.01); *B63G 8/42* (2013.01)

(58) Field of Classification Search
CPC ... B63G 7/00; B63G 7/02; B63G 8/16; B63G 8/28; B63G 8/42; B63G 2007/005; F41H 13/00
USPC ..... 89/1.13; 102/402, 403; 114/312, 331
See application file for complete search history.

(56) References Cited

U.S. PATENT DOCUMENTS

| | | | | |
|---|---|---|---|---|
| 2,967,504 A | | 1/1961 | Atanasoff et al. | |
| 3,012,534 A | * | 12/1961 | Thomas | B63G 7/02 102/402 |
| 3,903,798 A | * | 9/1975 | McGraw | B63G 7/02 102/403 |
| 3,906,884 A | | 9/1975 | Gould | |
| 3,938,459 A | * | 2/1976 | Wilbanks | B63B 3/06 114/77 R |

(Continued)

FOREIGN PATENT DOCUMENTS

| | | | | |
|---|---|---|---|---|
| DE | 4010686 A1 | * | 10/1991 | B63G 7/02 |
| DE | 4010686 A1 | | 10/1991 | |

OTHER PUBLICATIONS

International Search Report dated May 19, 2016 for counterpart PCT Application No. PCT/IB2016/050372.

*Primary Examiner* — Jonathan C Weber
(74) *Attorney, Agent, or Firm* — Shuttleworth & Ingersoll, PLC; Timothy J. Klima

(57) ABSTRACT

An apparatus for sweeping influence mines, including an operating unit having a plurality of propulsion devices designed to be immersed in water and at least one floating body connected to the propulsion devices, the latter being designed to overcome the hydrostatic thrust acting on the floating body to keep the operating unit immersed at a predetermined depth.

12 Claims, 2 Drawing Sheets

(56) References Cited

U.S. PATENT DOCUMENTS

| | | | | | |
|---|---|---|---|---|---|
| 4,185,578 | A * | 1/1980 | Reber | B63G 7/02 | 114/245 |
| 4,186,681 | A * | 2/1980 | Gish | B63G 9/00 | 102/402 |
| 4,188,905 | A * | 2/1980 | Weller | B63G 7/02 | 102/403 |
| 5,701,839 | A * | 12/1997 | Jasper | B63B 7/082 | 114/264 |
| 7,206,257 | B1 * | 4/2007 | Meng | F41H 13/0081 | 361/1 |

* cited by examiner

MINE SWEEPING APPARATUS

This application is the National Phase of International Application PCT/IB2016/050372 filed Jan. 26, 2016 which designated the U.S. and that International Application was published under PCT Article 21(2) in English.

This application claims priority to Italian Application No. BO2015A000027 filed Jan. 27, 2015, which application is incorporated by reference herein.

TECHNICAL FIELD

This invention relates to an apparatus for sweeping naval mines. More specifically, this invention relates to an apparatus for sweeping naval influence mines.

BACKGROUND ART

Even though the alternative technique of searching for mines which seeks to identify the mine is well established, the sweeping of mines, although it is a traditional tactic, maintains its considerable importance.

The sweeping consists in moving in the vicinity of the mine with devices which emulate the effect of the passage of a ship in order to explode the mine.

Moored mines, especially those of the impact type, have been shown to be easily swept with normal mechanical sweeping systems and the elimination of entire fields of this kind no longer constitutes a major problem.

However, mechanical sweeping is not found to be effective with the more modern influence mines which are positioned directly on the sea bed at depths of less than 100 meters and are manufactured in such a way as to activate by the influence of the magnetic mass a ship, or its noise or the pressure variation caused by the passage of a ship and, then, following the activation, explode.

In other words, these mines are characterised by the presence of sensors which are capable of detecting the signature of surface or underwater naval vessels and they therefore await explosion when this signature corresponds to a predetermined target.

Amongst the types of signature there are, as mentioned, the magnetic type, the acoustic type and the pressure due to the movement of water connected to the movement of a ship.

The optimal limit of use of influence mines from the sea bed is with a maximum sea bed of around 50-60 meters .

Influence sweeping therefore causes the explosion of a mine using for this purpose precisely the principle of triggering the mine.

Magnetic influence sweeping and acoustic influence sweeping are the most widespread and they comprise devices which are able to generate, respectively, suitable magnetic fields using coils or permanent magnets and acoustic noise using mechanical or electro-acoustic devices.

However, the main difficulties are found in the influence sweeping of pressure mines and in effect, at present, there are no known solutions actually used in practice.

Solutions have also been proposed in the past which are able to reproduce in the proximity of the surface the movement of water and the consequent underlying reduction in pressure of a ship by the pulling of shapes with overall dimensions comparable to that of the ships which are presumably the target of the mine (patent document U.S. Pat. No. 2,967,504).

A second solution prior art, illustrated in patent document U.S. Pat. No. 5,701,839, teaches the generation of a movement of air, a sort of suction, directed from the surface towards the underlying water, which is also able to simulate the negative pressure caused by the passage of a ship.

Both the above-mentioned prior art solutions require large-sized apparatuses and they have been found to be difficult to implement in practice, also in terms of costs and difficulty of use.

The provision is also known, from patent document DE 40 10 686, of a plurality of hydraulic suction machines supported by a floating body.

The prior patent document U.S. Pat. No. 3,012,534 teaches the alteration of the pressure field, designed to activate pressure mines. The above-mentioned alteration of the pressure field is achieved by means of a large tube, kept immersed in a horizontal position, constrained to surface floats and having inside it one or more hydraulic machines which are able to pump water from the inside of the tube towards the outside. This forced circulation of water alters the pressure field.

Both these latter solutions, as they are constrained to the water surface, have not been found to be fully effective in the presence of direct mines for example to strike underwater targets or moving on deeper sea beds.

More specifically, a drawback connected to the use of the latter solution is the impossibility of quickly varying the immersion level, which is often due to changeable operating conditions, often in a rapid fashion.

DISCLOSURE OF THE INVENTION

The aim of this invention is to provide an apparatus for sweeping influence mines which is inexpensive to make and practical to use.

Another aim of this invention is to provide an apparatus for sweeping which is effective in activating pressure mines and which is compact and with a reduced power.

The aim of this invention is to provide a sweeping apparatus that is free of the drawbacks of the prior art solutions.

The technical features of the invention, with reference to the above aims, can be easily inferred from the appended claims, in particular claim 1, and preferably any of the claims that depend, either directly or indirectly, on that claim.

BRIEF DESCRIPTION OF DRAWINGS

The advantages of the invention are more apparent from the detailed description which follows, with reference to the accompanying drawings which illustrate a preferred, non-limiting example embodiment of the invention and in which.

DETAILED DESCRIPTION OF PREFERRED EMBODIMENTS OF THE INVENTION

Figure 1:
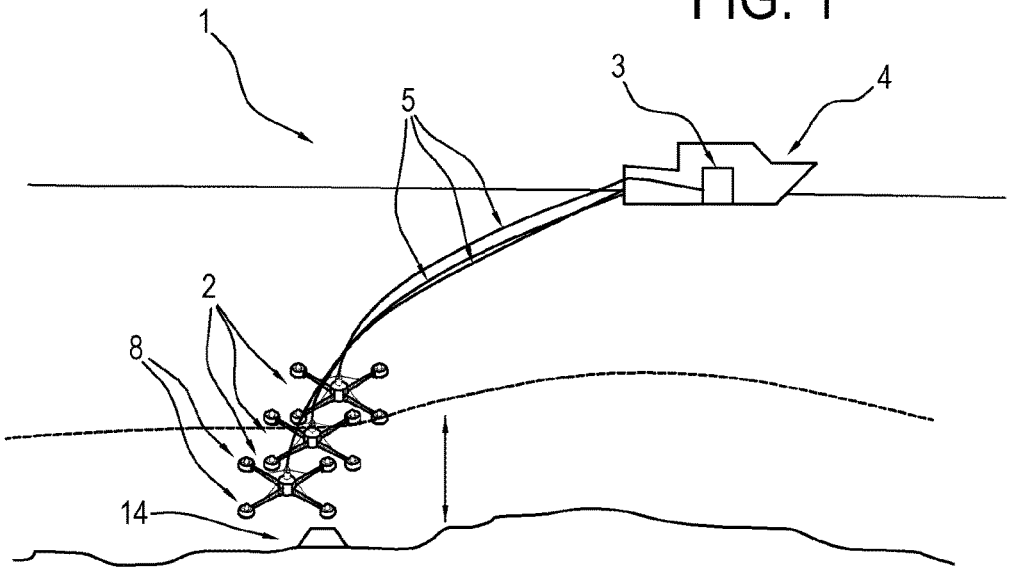
FIG. 1 is a schematic view of preferred embodiments of the apparatus for sweeping influence mines according to this invention, in use in the sea for sweeping mines.

With reference to FIG. 1, the numeral 1 denotes in its entirety an apparatus for sweeping influence mines according to this invention.

The apparatus 1 comprises more than one operating unit 2 designed to position itself in water at a predetermined depth, a power supply, command and control unit 3 advantageously located on a vessel 4, and a cable 5 for connecting between the operating unit 2 and the power supply, command and control unit 3.

The apparatus 1 and of the vessel 4 together define a system for sweeping influence mines.

Figure 2:
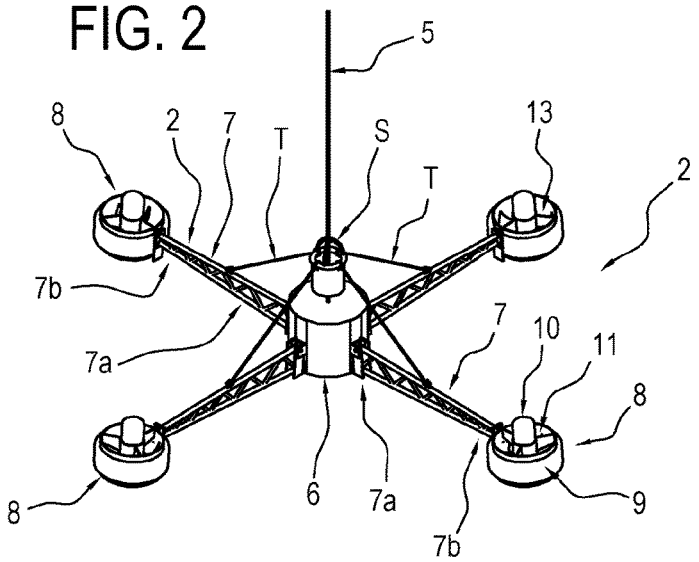
FIG. 2 is a schematic perspective view of a detail of the apparatus of FIG. 1, in a relative open configuration.

As shown in FIG. 2, the operating unit 2 comprises a central body 6 from which a plurality of rigid arms 7 extends.

Each arm 7 has a first proximal end 7*a*, at which the arm 7 is hinged on the central body 6, and a second distal end 7*b*, longitudinally opposite the above-mentioned first proximal end 7*a*.

Each arm 7 supports, at the relative distal end 7*b*, a propulsion device 8.

In the preferred embodiment illustrated in the accompanying drawings, the propulsion device 8 comprises an outer annular band 9, a motor 10 (covered by a respective casing) and a propulsive propeller 11 having a plurality of blades 12.

The above-mentioned motor 10 is designed to rotate the propulsive propeller 11 for generating a movement in the water in which the propulsion device 8 is immersed.

The motor 10 is, advantageously, an electric induction motor or a motor with permanent magnets (brushless) and is protected for underwater immersion.

The propulsive propeller 11 is advantageously a pulling propeller.

The propulsive propeller 11 is configured to create, with its relative rotation, a negative pressure in the relative vicinity, when the unit is shut down or at slow speed, and designed to cause the movement of the operating unit 2.

In other words, the propulsion device 8 is configured to cause the movement of a mass of water.

This movement is designed to generate a propulsive thrust in a vertical direction which is able to contrast the hydrostatic thrust acting on the floating body 6 to move the operating unit 2 until reaching a predetermined depth as well as keep the operating unit 2 immersed at that predetermined depth.

The propulsion device 8 is also configured to cause, by the above-mentioned movement of a mass of water, a negative pressure in the region of water below the propulsion device 8.

The expression "predetermined depth" means, for the purpose of this invention, a variable depth.

Different depths can be reached by exploiting the propulsive thrust generated by the propulsion device 8.

As a result of the double aim of the shape of the propeller and the annular outer band 9 they are suitably designed to optimise both the functions.

In the maritime field, propulsive propellers may be basically divided, on the base of their operating mode, into pulling propellers and pushing propellers.

Pulling propellers are propellers normally positioned on the front part of the propulsive device and therefore designed to provide the propulsion by sucking the undisturbed fluid which is in front of the device in the direction of travel. For the sake of simplicity, this mode of operation may be described as a pulling action, and this results in the definition of pulling propellers.

Pushing propellers are similar to pulling propellers but, unlike these, they are located at the back of the propulsion device. Thanks to their positioning, they come into contact in front with a fluid with non-uniform motion which feels the effect of the passage between the fluid dynamic surfaces of the device. The action of this propeller can therefore simply be described as a pushing action, which results in the definition of pushing propeller. The vast the majority of marine propellers used on all the types of vessels belong to this type.

The above-mentioned motor 10 is supported by the annular band 9 using a plurality of supporting spokes 13.

The casing of the motor 10 advantageously has a torpedo type hydrodynamic shape.

Figure 4:
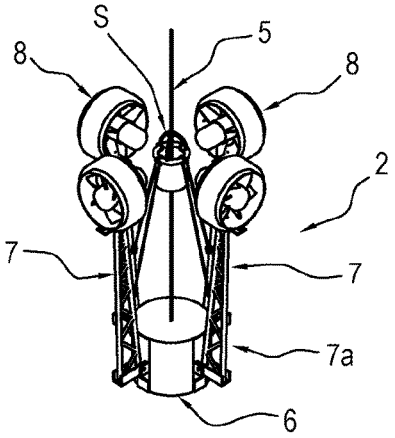
FIG. 4 is a schematic perspective view of the detail of FIG. 2 in a partially closed configuration.
Figure 3:
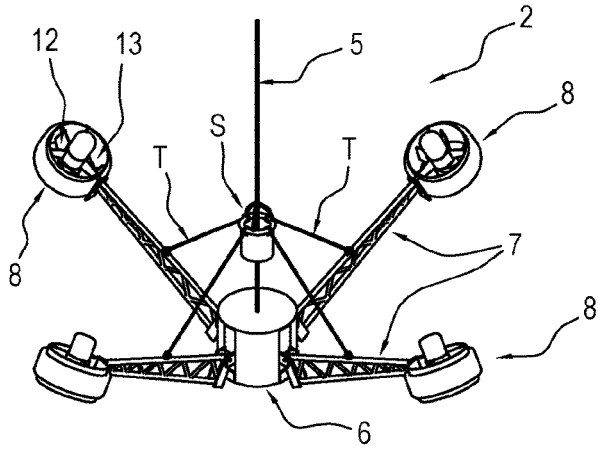
FIG. 3 is a schematic perspective view of the detail of FIG. 2 in a partially closed configuration.

The arms 7, as mentioned above, are hinged on the central body 6 to move the propulsion devices 8 supported by them between an open operating configuration defining a condition of maximum dimensions of the operating unit 2, shown in FIG. 2, and a closed non-operating configuration, for storage of the operating unit 2 shown in FIG. 4.

As clearly shown in FIG. 4, in the relative closed configuration, the operating unit 2 has a reduced size.

The arms 7 are made advantageously in the form of lattice beams.

In order to allow the passage between the two open and closed configurations, the operating unit 2 comprises an element S slidable along the cable 5, connected with respective tie rods T to each arm 7.

The moving away of the slidable element S from the central body 2 causes the folding of the arms 7 and the reaching of the above-mentioned closed configuration.

The central body 6 comprises inside it a space, not shown in detail, defining a floating body.

The above-mentioned floating body (not illustrated in detail) is designed to generate, when the operating unit 2 is immersed in water, a hydrostatic thrust, if not adequately contrasted, so as to return the operating unit 2 to the surface.

The space defining the floating body is therefore suitably sized as a function of the mass of the operating unit 2 and the negative pressure which the unit 2 must generate.

The space defining the floating body is either empty and sealed in a watertight fashion, or filled with a material having a density markedly less than that of the sea water, such as, for example, expanded polystyrene or the like.

The central body 6 advantageously contains electronic devices, not illustrated, for controlling the above-mentioned motors of the propulsion devices 8.

As illustrated in FIG. 1, the power supply, command and control unit 3 is, as already mentioned, housed on a vessel and operatively connected to the operating unit using the cable 5 for controlling the operation.

Advantageously, the connecting cable 5 leading from the power supply, command and control unit 3 positioned on the vessel 4 is also designed to pull the operating unit 2 along the route defined for sweeping the requested section of sea.

The plurality of operating units 2 are preferably connected to a same power supply, command and control unit 3.

In other words, the power supply, command and control unit 3 is configured for managing and coordinating the operation of the various operating units 2 of the plurality of operating units.

Each operating unit 2 comprises at least one level transducer, not illustrated, designed to detect the distance from the sea bed of the operating unit 2.

The level transducer is connected with the power supply, command and control unit 3.

By way of an example, the above-mentioned and not illustrated level transducer comprises a depth sounding device and/or pressure sensors.

Advantageously, the operating units 2 in a group comprise position sensors integral with the units 2, preferably acoustic, which, measuring the distance of the adjacent unit 2, provide the information, together with the depth and orientation measurement, to a local command and control unit housed in the central body 6. The command and control unit controls the propulsion devices 8 in such a way as to keep each unit 2 at a predetermined distance from the others.

Operatively, the combined control of the propulsion devices 8 allows the operating unit 2 to manoeuvre in the same way as an aerial drone equipped with multiple propellers.

Figure 5:
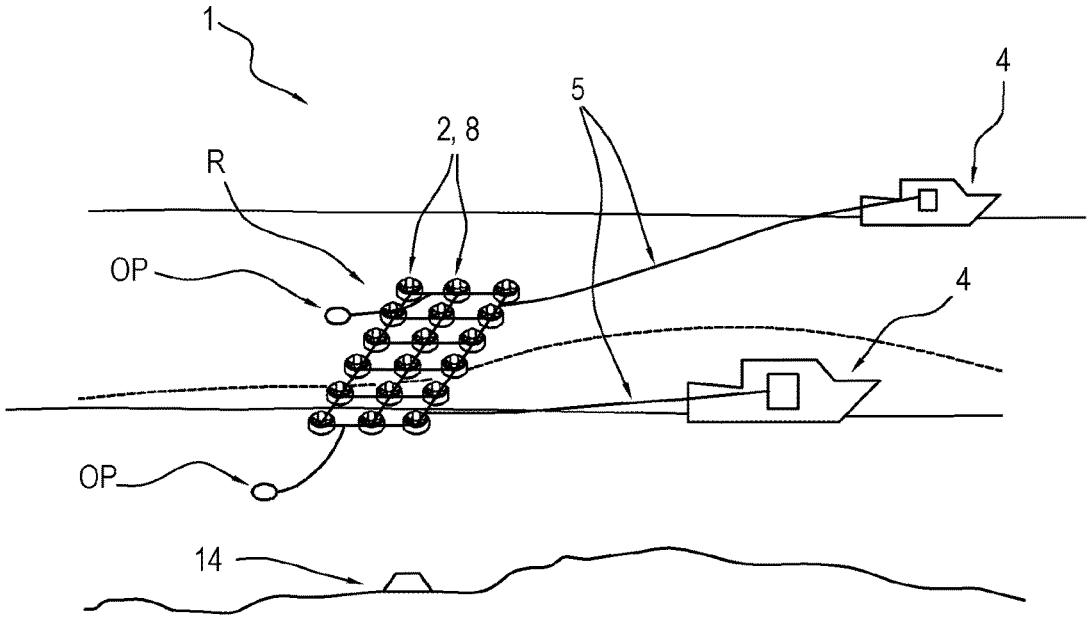
FIG. 5 is a schematic view of another embodiment of the sweeping apparatus of FIG. 1.

In an alternative embodiment not illustrated, the relative position between the operating units 2 is maintained by means of non-rigid mechanical connections between the units 2, for example, ropes, and the units which are at the formation angles are placed in traction from vessels or from hydrodynamic bodies (also known in jargon as "Oropesa" and illustrated schematically in FIG. 5 with the reference OP).

A further variant of the system, illustrated in FIG. 5, comprises operating units 2 each comprising only one propulsion device 8. The propulsion devices 8 are connected to each other by cables to form a network R with the cables not only maintaining the formation but also distributing electricity and transmitting signals.

In addition to the generation of a pressure signature with an active system the operation of which is described below, the sweeping apparatus 1 according to this invention is designed for generating other types of influence, such as magnetic and acoustic types.

Advantageously, the sweeping apparatus 1 according to this invention comprises means, not illustrated, for generating a magnetic field to activate magnetic influence mines positioned in the proximity of the apparatus 1.

The magnetic signature to be reproduced must take into account the fact that the magnetic field normally generated by a navigating vessel is characterised by a vector flow, comprised, therefore, of three space-related components.

The reproduction of the magnetic signature therefore requires that the three components follow a specific trend in space around the objective. Two or three separate solenoids are typically used to do this, positioned on axes at right angles.

In the preferred embodiment according to this invention, a solenoid, not illustrated, with a vertical axis, is integrated in the outer annular band 9 of the propulsion device 8.

Other solenoids are advantageously integrated inside the cap 10 covering the motor or in the central body 6 or along the rigid arms 7.

Basically, each of the above-mentioned solenoids forms the magnetic field of a magnetic dipole and all these dipoles may be combined both spatially and in terms of intensity and sign to create complex magnetic signatures.

Alternatively, the magnetic signature is formed using permanent magnets conveniently housed in the unit 2.

Advantageously, the sweeping apparatus 1 according to this invention in a more complete embodiment comprises means, not illustrated, for generating acoustic noise to activate acoustic influence mines positioned in the proximity of the apparatus 1.

It is evident that the apparatus 1 already intrinsically produces an acoustic signature due to the effect of the noise generated by the motor propulsion devices 8.

The propulsion devices 8 may be designed to be noisy but that would, naturally, result in a loss of efficiency. In effect, the noise level may be due to the hydrodynamic part, for example the shape of the propeller 11, or also, for example, by a mechanical part keyed onto the movement shaft of the propeller 11. In both cases, the reduction of performance is evident.

The acoustic signature may therefore be improved in terms of energy efficiency with the use of specific devices, not illustrated, integral with the operating unit 2, or connected to the cable 5, designed to emit sounds at predetermined frequencies. These devices define the above-mentioned and not illustrated means for generating acoustic noise.

Thanks to the fact that the unit 2 is made to operate close to the sea bed and, therefore, near any mines to be exploded, high power devices are not consequently required.

In use, as illustrated in FIG. 1, the apparatus 1 according to this invention is positioned near the sea bed on which it is assumed that influence mines can be found, as illustrated schematically in FIG. 1 and denoted by the numeral 14. More specifically, the mine 14 is a pressure influence mine, which may also, or alternatively, be sensitive to acoustic noise and magnetic field.

For this reason, the positioning of the apparatus 1 in the proximity of the mine differs from the prior art systems which propose reproducing a ship and which therefore have a development in terms of dimensions and position corresponding to a ship. They are therefore on the surface and have dimensions comparable to those of a ship.

Since influence mines of known type have substantially punctiform sensors, they, for "detecting" the length of a ship, on the basis of which measurement they activate, or do not activate, the relative operation, assuming a certain speed of forward movement, use in practice the time which the ship takes to cross a predetermined space.

Due to the fact of having the apparatus 1 very close to the sea bed and, therefore, to the mine 14, the apparatus 1 may trick the means for detecting the mine with a signal (described in more detail below) having an absolute value which is also much less than that which a ship would generate.

However, with regard to the length of the actual ship which is the target of the mine 14, for the kinematic law S=V*T (where S=space, V=speed, T=time) the smaller space swept by the apparatus 1 may be compensated for by conveniently reducing its speed of forward movement, with the following equation:

$$T=L_0/V_0=L1/V1$$

where

T=crossing time $L_0$=length of actual target ship $V_0$=speed of actual target ship L1=length of operating unit 2

V1=speed of operating unit 2.

With regard to the generation of the above-mentioned pressure signal which is able to simulate the pressure variation in the water caused by the passage of a ship, the operation of the sweeping apparatus 1 is as follows.

As described above, the propellers 11 of the propulsion devices are able create a negative pressure in the direction of motion and where, therefore, the movement of the water is the result of a pressure difference between the zone in front of and the zone behind the propeller 11.

With reference to FIG. 1, the term "zone in front of" the propeller 11 means the zone facing towards the sea bed whilst the "zone behind" the propeller 11 means the zone facing towards the surface of the sea.

This negative pressure produced by the rotation of the propeller 11 in the front part of the propulsion device 8 is used by the apparatus 1 for simulating the negative pressure generated by a moving ship and thereby tricking any pressure influence mine positioned in the vicinity.

It has been found experimentally that the emission power of simulation signals (in influence sweeping) required in the magnetic, acoustic and pressure types increases approximately by the cube of the height from the sea bed.

The circumstance highlighted above shows the degree of compactness and the reduced power (also in terms of energy absorption) required by a sweeping apparatus according to this invention compared with the prior art solutions currently in use.

In effect, thanks to the vertical mobility of the apparatus according to this invention, it may be positioned close to the sea floor, that is, close to the potential mines, thus being able to simulate with limited power, thanks to the closeness to the mines themselves, the signature even of large ships.

Moreover, advantageously, the opportunity of varying the level allows the required signature to be adapted to a wide range of ships. In other words, under equal conditions of power used to generate the above-mentioned negative pressure, by varying the level of the apparatus 1 it is possible to simulate the effects of ships and boats of different sizes.

As an alternative to the pulling by the vessel 4 using the cable 5, the operating unit 2 is configured for moving in water under its own motion, by a suitable combination of the propulsive action of the individual propulsion devices 8; a combination managed by the power supply, command and control unit 3.

In other words, the movement in water of each operating unit 2 would not be unlike that of the aerial drones equipped with multiple propellers.

According to this mode of operation, the connection cable 5 no longer performs the pulling function but solely the power supply and data transmission.

A plurality of operating units 2 form a modular solution which allows the area covered by the sweeping to be varied by varying the number of units 2. The decision to operate underwater allows the power to be reduced as indicated above but also reduces, even if by a lower factor, the area of influence of the device relative to a system operating on the surface. A minimum number of operating units 2 is therefore required to compensate for this reduction in the area.

A further variant of use of the apparatus according to this invention, not illustrated, is that in which the pressure sweeping is not necessary. Since emulation of the pressure is the factor which requires a numerous formation of units 2 at relatively low level, the system can be conveniently used with a reduced number of operating units 2. This number may be considerably reduced to two, or even one, operating unit 2.

According to one variant embodiment of this invention, not illustrated, the propeller of the propulsion device 8 is of the so-called "rim driven" type, that is to say, having an electric motor integrated in the shell formed by the above-mentioned outer annular band 9.

There are various prior art solutions for making the electric motor in terms of coupling between stator and rotor compared with the traditional linear motor with a ring shape.

Typically, the motor is synchronous with permanent magnets in the rotor.

The magnetic signature of this type of motor is high and this allows it to be used to generate, at least partly, the magnetic flow required for influence sweeping.

The requested signature compensation which is not formed by the motor itself is advantageously obtained by means of solenoids, not illustrated, integrated in the annular outer band of the propulsion device 8 or in an annular band which connects the propulsion devices 8.

The invention achieves significant advantages, including the underwater operation which makes the system relative immune from the conditions of the sea, and achieves the preset aims.

The invention claimed is:

1. An apparatus for sweeping influence mines, comprising: an operating unit including at least one propulsion device for immersion in a body of water and at least one floating body connected to the at least one propulsion device, the at least one propulsion device being configured to generate, by movement of a mass of water, a propulsive thrust in a vertical direction for counteracting a hydrostatic thrust acting on the at least one floating body to cause movement of the operating unit until reaching a predetermined depth and to keep the operating unit immersed at the predetermined depth, the at least one propulsion device also being configured to cause, by the movement of the mass of water, a negative pressure in a region of the body of water below the at least one propulsion device and closer to a bottom of the body of water, the negative pressure configured to activate a pressure influence mine positioned in a proximity of the operating unit.

2. The apparatus according to claim 1, wherein the at least one propulsion device comprises an electric motor and a propulsive propeller connected to the electric motor, the electric motor configured for rotating the propeller; the propeller being a pulling propeller configured to generate, with rotation of the propeller, the negative pressure, the negative pressure also configured to cause the movement of the operating unit.

3. The apparatus according to claim 1, wherein the at least one propulsion device includes a plurality of propulsion devices rigidly connected together.

4. The apparatus according to claim 3, further comprising a plurality of rigid arms, each of the plurality of rigid arms respectively supporting one of the plurality of propulsion devices, wherein the plurality of propulsion devices are moveable between an open operating configuration of the plurality of rigid arms defining a condition of maximum dimensions of the operating unit, and a closed non-operating configuration of the plurality of rigid arms defining a reduced dimension of the operating unit for storage of the operating unit.

5. The apparatus according to claim 1, further comprising a power supply, command and control unit, the power supply, command and control unit configured to be housed in a remote vessel and operatively connected to the operating unit for controlling operation of the apparatus.

6. The apparatus according to claim 5, further comprising a cable for connecting the power supply, command and control unit to the operating unit.

7. The apparatus according to claim 5, further comprising a plurality of the operating units, wherein the power supply, command and control unit is connected to and configured for managing and coordinating operation of the plurality of the operating units.

8. The apparatus according to claim 7, wherein each of the plurality of operating units are connected to each other by flexible connections to form a network.

9. The apparatus according to claim 7, wherein each of the plurality of operating units comprises at least one level transducer to detect a distance from the bottom of the water body to the operating unit.

10. The apparatus according to claim 1, further comprising a magnetic field generator for generating a magnetic field to activate magnetic influence mines positioned in proximity of the apparatus.

11. The apparatus according to claim 1, further comprising an acoustic generator for generating acoustic noise for activating acoustic influence mines positioned in proximity of the apparatus.

12. A system for sweeping influence mines comprising: at least one apparatus for sweeping influence mines, comprising: an operating unit including at least one propulsion device for immersion in a body of water and at least one floating body connected to the at least one propulsion device, the at least one propulsion device being configured to generate, by movement of a mass of water, a propulsive thrust in a vertical direction for counteracting a hydrostatic thrust acting on the at least one floating body to cause movement of the operating unit until reaching a predetermined depth and to keep the operating unit immersed at the predetermined depth, the at least one propulsion device also being configured to cause, by the movement of the mass of water, a negative pressure in a region of the body of water below the at least one propulsion device and closer to a bottom of the body of water, the negative pressure configured to activate a pressure influence mine positioned in a proximity of the operating unit; and at least one vessel to which the at least one apparatus is connected.

* * * * *